US006588213B2

(12) United States Patent
Newburry

(10) Patent No.: US 6,588,213 B2
(45) Date of Patent: Jul. 8, 2003

(54) CROSS FLOW COOLED CATALYTIC REACTOR FOR A GAS TURBINE

(75) Inventor: Donald M. Newburry, Broken Arrow, OK (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 19 days.

(21) Appl. No.: 09/965,609

(22) Filed: Sep. 27, 2001

(65) Prior Publication Data

US 2003/0056519 A1 Mar. 27, 2003

(51) Int. Cl.[7] ..... F23R 3/40
(52) U.S. Cl. ..... 60/777; 60/723; 431/328
(58) Field of Search ..... 60/723, 777; 431/328, 431/170

(56) References Cited

U.S. PATENT DOCUMENTS

| | | | | |
|---|---|---|---|---|
| 3,928,961 A | | 12/1975 | Pfefferle | |
| 3,982,910 A | * | 9/1976 | Houseman et al. | 48/61 |
| 4,790,744 A | | 12/1988 | Bellet et al. | |
| RE33,013 E | | 8/1989 | Takeuchi et al. | |
| 4,870,824 A | | 10/1989 | Young et al. | |
| 5,191,930 A | | 3/1993 | Chaney | |
| 5,202,303 A | | 4/1993 | Retallick et al. | |
| 5,250,489 A | | 10/1993 | Dalla Betta et al. | |
| 5,375,999 A | * | 12/1994 | Aizawa et al. | 431/328 |
| 5,476,375 A | * | 12/1995 | Khinkis et al. | 431/7 |
| 5,512,250 A | | 4/1996 | Betta et al. | |
| 5,518,697 A | | 5/1996 | Dalla Betta et al. | |
| 5,628,181 A | | 5/1997 | Kraemer | |
| 5,826,429 A | | 10/1998 | Beebe et al. | |
| 6,092,363 A | | 7/2000 | Ryan | |
| 6,105,360 A | | 8/2000 | Willis | |
| 6,415,608 B1 | * | 7/2002 | Newburry | 60/723 |

OTHER PUBLICATIONS

Schlatter, James C. et al. Single–Digit Emissions in a Full Scale Catalytic Combustor. Presented at the International Gas Turbine & Aeroengine Congress & Exhibition, 1997. New York; The American Society of Mechanical Engineers, 1997. (97–GT–57).

Fant, D.B., et al. Status of Catalytic Combustion R&D For the Department of Energy Advanced Turbine Systems Program. Presented at the International Gas Turbine & Aeroengine Congress & Exhibition, 1999. New York, The American Society of Mechanical Engineers, 1999. (99–GT–57).

Proposal for development contract 995021A; Siemens Westinghouse Power Corporation, Apr. 1999.

* cited by examiner

*Primary Examiner*—Ehud Gartenberg

(57) ABSTRACT

A catalytic combustor (34) for a gas turbine engine (30). A fuel-air mixture (50) is reacted on a catalytic surface (54) of a catalytic heat exchanger module (36) to partially combust the fuel (48) to form heat energy. The fuel-air mixture is formed using compressed air (44) that has been pre-heated to above a reaction-initiation temperature in a non-catalytic cooling passage (46) of the catalytic heat exchanger module (36). Because the non-catalytic cooling passages (46) provide the necessary pre-heating of the combustion air, no separate pre-heat burner is required. Fuel (48) is added to the pre-heated air (44) downstream of the non-catalytic cooling passage (46) and upstream of the catalytic surface (54), thereby eliminating the possibility of flashback of flame into the cooling passages (46). Both can-type (60) and annular (80) combustors utilizing such a combustion system are described.

9 Claims, 2 Drawing Sheets

CROSS FLOW COOLED CATALYTIC REACTOR FOR A GAS TURBINE

FIELD OF THE INVENTION

This invention relates generally to the field of combustion turbines, and more specifically to a gas turbine including a catalytic combustor, and in particular to a passively cooled catalytic combustor having improved protection against overheating and a wider operating range.

BACKGROUND OF THE INVENTION

In the operation of a conventional combustion turbine, intake air from the atmosphere is compressed and heated by a compressor and is caused to flow to a combustor, where fuel is mixed with the compressed air and the mixture is ignited and burned. This creates a high temperature, high pressure gas flow which is then expanded through a turbine to create mechanical energy for driving equipment, such as for generating electrical power or for running an industrial process. The combustion gasses are then exhausted from the turbine back into the atmosphere. Various schemes have been used to minimize the generation of pollutants during the combustion process. The use of catalytic combustion is known to reduce the generation of oxides of nitrogen since catalyst-aided combustion can occur at temperatures well below the temperatures necessary for the production of NOx species.

FIG. 1 illustrates a prior art gas turbine combustor 10 wherein at least a portion of the combustion takes place in a catalytic reactor 12. Compressed air 14 from a compressor (not shown) is mixed with a combustible fuel 16 supplied through fuel injectors 18 upstream of the catalytic reactor 12. Catalytic materials present on surfaces of the catalytic reactor 12 initiate the heterogeneous combustion reactions at temperatures lower than normal ignition temperatures. However, for certain fuels and engine designs such as natural gas lean combustion, known catalyst materials are not active at the compressor discharge supply temperature. A preheat burner 20 is provided to preheat the combustion air 14 by combusting a supply of preheat fuel 22 upstream of the main fuel injectors 18. One such system is described in U.S. Pat. No. 5,826,429 issued on Oct. 27, 1998, incorporated by reference herein. Such pre-burn systems are costly and they add complexity to the design and operation of the combustor.

The surface reactions within the catalytic reactor release enough heat energy to cause auto-ignition and combustion of the remainder of the fuel in the gas stream beyond the catalytic reactor 12, in a region of the combustion chamber called the burnout zone 24. For modern high firing temperature combustion turbines, the amount of fuel reacted in the catalyst bed must be limited in order to prevent overheating of the materials within the reactor. In order to cool the catalytic reactor 12 and to limit the amount of conversion within the reactor, it is known to provide both catalyzed and non-catalyzed substrate passages through the catalytic reactor 12. Such designs are described in U.S. Pat. No. 4,870,824 dated Oct. 3, 1989, and U.S. Pat. No. 5,512,250 dated Apr. 30, 1996, also incorporated by reference herein. The fuel-air mixture passing through the non-catalyzed passages serves to cool the catalytic reactor 12 while retaining the removed heat in the combustion gas stream. While such passive cooling is an improvement over previous designs, there remains a risk of the fuel-air mixture in the non-catalyst cooling passages igniting or of the flame traveling upstream into the non-catalyzed cooling passages. In such an event, the cooling action will be lost and the catalyst may overheat and fail.

SUMMARY OF THE INVENTION

Accordingly, an improved catalytic combustor is needed to reduce the risk of overheating of the catalytic reactor. Furthermore, a simple and cost effective catalytic combustor is needed for applications where the gas supply temperature is below the temperature necessary to activate the catalyst.

A combustor is described herein as having: a heat exchanger module having catalytic passages in a heat exchange relationship with non-catalytic passages; a fuel injection apparatus; and a means for directing combustion air in sequence through the non-catalytic passages, the fuel injection apparatus and the catalytic passages. Because the air traveling through the non-catalytic passages does not contain fuel, the risk of flash-back of the flame into these cooling passages is eliminated.

In one embodiment, a combustor is described herein as including: a plurality of catalyst modules disposed in a generally circular pattern at the inlet of an annular combustor chamber within an engine casing; a seal between the plurality of catalyst modules and the engine casing for directing a flow of air into contact with non-catalytic surfaces of the respective catalyst modules; a plurality of fuel injectors associated with the plurality of catalyst modules for injecting a combustible fuel into the flow of air downstream of the non-catalytic surfaces to form a fuel-air mixture; and a plurality of catalytic surfaces formed on the catalyst modules for contacting the fuel-air mixture downstream of the non-catalytic surfaces and for causing a first portion of the fuel to combust within the respective catalyst modules and a second portion of the fuel to combust within the combustion chamber.

A gas turbine is described herein as including: a compressor for providing a flow of air; a combustor for combusting a flow of fuel in the flow of air to produce a flow of combustion gas; and a turbine for extracting energy from the flow of combustion gas; wherein the combustor further comprises: a catalyst module having a catalytic surface and a non-catalytic surface in heat exchange relationship there between; a fuel delivery apparatus; and a flow directing apparatus for directing the flow of air in sequence from the non-catalytic surface to the fuel delivery apparatus to the catalytic surface.

A method of combusting a fuel is described herein as including the steps of: providing a catalyst device having a catalytic surface in heat exchange relationship with a non-catalytic surface; directing fuel-free air over the non-catalytic surface to remove heat energy from the catalyst device and to pre-heat the fuel-free air; adding a combustible fuel to the fuel-free air to form a fuel-air mixture; and directing the fuel-air mixture over the catalytic surface to combust at least a first portion of the fuel-air mixture and to generate heat energy.

BRIEF DESCRIPTION OF THE DRAWINGS

In the course of the following detailed description, reference will be made to the following drawings in which.

DETAILED DESCRIPTION OF THE INVENTION

Figure 1:
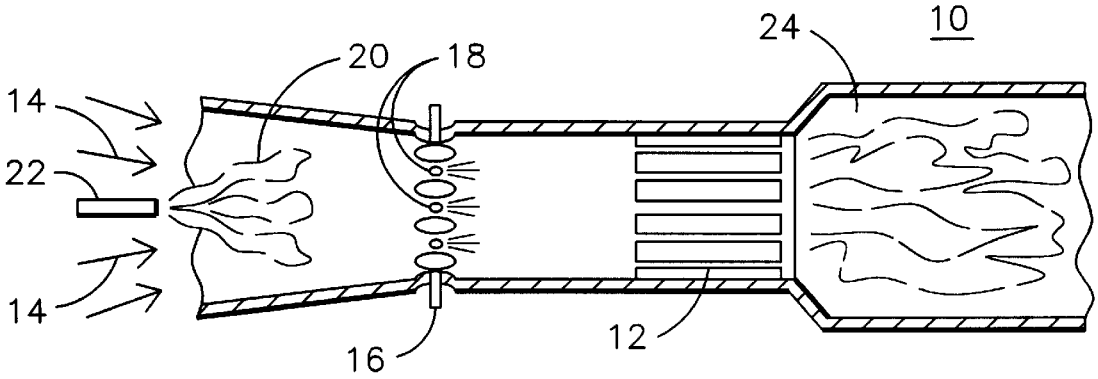
FIG. 1 PRIOR ART
FIG. 1 is a schematic side sectional view of a prior art catalytic combustor.
Figure 2:
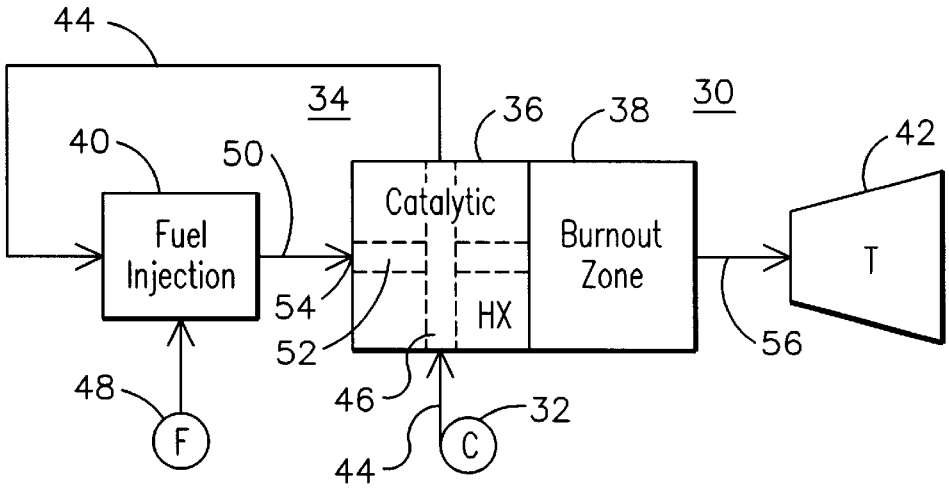
FIG. 2 is a schematic illustration of a gas turbine engine incorporating a catalytic heat exchanger.

An improved gas turbine engine 30 is illustrated in FIG. 2 as including a compressor 32, a combustor 34 having both a catalytic combustion heat exchanger module 36 and a homogeneous burnout zone combustion chamber 38 as well as a fuel injection apparatus 40, and a turbine 42. Compressed air 44 is delivered from the compressor 32 to a fuel injection location through a first plurality of non-catalytic passages 46 in the catalytic module 36. At the fuel injection location, the air 44 flows through a fuel injection apparatus 40 where a flow of combustible fuel 48 suitable for a combustion turbine is added to form a fuel-air mixture 50. The fuel-air mixture 50 then passes through a second plurality of passages 52 in the catalytic module 36 where one or more surface-exposed catalyst materials 54 initiates the heterogeneous combustion of the fuel-air mixture 50. The catalyst material defining the catalytic passages 52 may be any catalyst known in the art to be effective for the fuel being burned, for example, platinum or palladium deposited on a thin ceramic wash coat having a high specific surface area on a metal substrate. The catalytic passages 52 are sealed from and are in a heat exchange relationship with the non-catalytic passages 46. The structure of the catalytic heat exchanger 36, including the material defining the non-catalytic passages 46, may be any metal or ceramic material known in the art to be useful in such a combustion environment. Combustion is completed in the burnout zone portion 38 of combustor 34, and the hot combustion gas 56 is delivered to the turbine 42, where it is used to generate mechanical energy in a manner known in the art.

Heat energy is generated within the catalytic module 36 by the heterogeneous combustion of the fuel-air mixture 50 within the catalytic passages 52, and heat energy is removed from the catalytic module 36 by the pre-heating of the compressed air 44 as it passes through the non-catalyst passages 46. In one embodiment, the compressed air 44 provided by the compressor 32 may be at about 750° F. and it may be pre-heated within the catalytic heat exchanger 36 to a temperature of about 950° F. Following combustion of at least a first portion of the fuel-air mixture 50 within the catalytic module 36, the air temperature may have been increased to about 1,600° F. Following combustion of a second portion of the fuel-air mixture 50 within the combustion chamber burnout zone 38, the temperature of the combustion gas 56 may have been increased to about 2,700° F. The compressed air 44 is pre-heated in the non-catalytic cooling passages 46 to at least a temperature sufficient to initiate the catalytic reaction within the catalytic passages 52, thereby eliminating the need for any pre-burner. Furthermore, since the catalytic module 36 is passively cooled with fuel-free compressed air 44, there is no concern about flashback or auto-ignition in the cooling channels 46. Accordingly, the gas turbine 30 of FIG. 2 may be less costly to design and manufacture than prior art devices having a pre-burner, and it may be less prone to overheating due to unanticipated back-propagation of the flame. Because at least a portion of the fuel is burned in the catalytic reactor 36, a stable, complete combustion process having NOx emissions of less than 3 ppm in the exhaust gas may be achieved.

Figure 3:
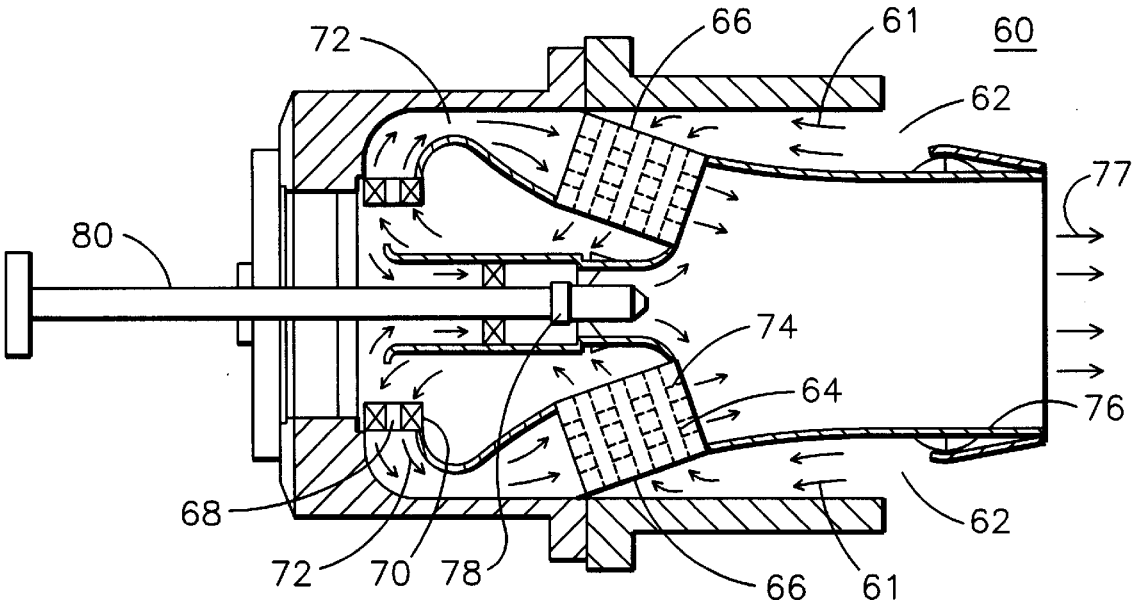
FIG. 3 is a partial cross-sectional view of a can-type combustor for a gas turbine engine incorporating a catalytic heat exchanger.

FIG. 3 is a partial cross-sectional view of a combustor that may be used in a gas turbine engine 30 as described with respect to FIG. 2. The combustor 60 would be used in a can-type combustion system, as is currently known to be used in Siemens Westinghouse Power Corporation Model 501F gas turbine engines. In a Model 501F engine, sixteen such combustors 60 would be spaced circumferentially about an outlet end of a compressor, radially displaced from a longitudinal axis of the turbine. The combustors 60 would be housed in a generally cylindrical casing (not shown) which provides a flow communication for compressed air 61 between the compressor outlet (not shown) and an annular inlet opening 62 of combustor 60. The compressed air 61 is then directed by the shell 63 of the combustor 60 over a non-catalytic surface 64 of a catalyst module 66 to a fuel delivery location 68. While passing over the non-catalytic surface 64, the compressed air 61 removes heat from the catalyst module 66, thus pre-heating the compressed air 61. At the fuel delivery location 68, a fuel injection apparatus 70 introduces a flow of fuel into the pre-heated air to form a fuel-air mixture 72. The fuel injection apparatus 70 may be a combination swirl vane/nozzle combination as is known in the art for injecting the fuel and pre-mixing the fuel and the air together to form the fuel-air mixture 72. The fuel-air mixture 72 is pre-heated by contact of the compressed air 61 with the non-catalytic surface 64 to a temperature sufficiently high to initiate combustion of the fuel-air mixture 72 when it is next directed over a catalytic surface 74 of catalyst module 66. Catalyst module 66 may be formed as a cross-flow device, as illustrated, wherein the non-catalytic passages and the catalytic passages are formed to be at approximately right angles to each other. Other designs may be envisioned wherein the non-catalytic passages and the catalytic passages are parallel to each other or are otherwise aligned to be in a heat-exchange relationship with each other. At least a first portion of the fuel-air mixture 72 is combusted within the catalyst module 66, and a second and preferably completed portion of the fuel-air mixture 72 is combusted in a burnout zone defined by a generally tubular-shaped combustion chamber 76. The hot combustion gas 77 is then directed to a transition piece (not shown) and into a downstream turbine, as shown in FIG. 2.

The catalyst module 66 is illustrated in cross-section as having an annular ring shape. Alternatively, a plurality of such modules may be disposed in a side-by-side configuration around an annular inlet to the combustion chamber 76. The main fuel injection upstream of the modules may be divided into stages that are turned on at different times as the engine load is increased and turned off as the engine load is decreased. A portion of the combustion air 61 is directed away from the main fuel injection apparatus 70 into a pilot burner 78. The pilot burner is provided with one or two additional fuel lines 80 that may be used for engine startup and for low load operation. Fuel supply to the pilot burner 78 may be reduced or eliminated at higher loads or whenever the flame in the combustion chamber 76 is stable in order to reduce the overall emissions of the engine. For natural gas fuel applications, an alternative fuel such as hydrogen or propane may be added to the main fuel supply to facilitate the heat-up of the catalyst module 66, since these are much easier to react catalytically than is methane. Once the catalyst module 66 has reached a desired temperature, the compressed air 61 will be heated to a temperature where the catalytic reaction of the natural gas-air mixture will occur, and the alternative fuel supply may be terminated.

Figure 4:
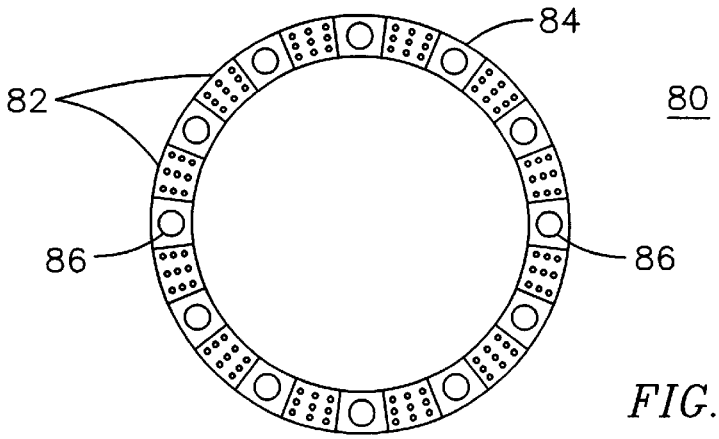
FIG. 4 is an end view of an annular-type combustion system incorporating a plurality of catalytic modules interspaced with a plurality of pilot burners.
Figure 5:
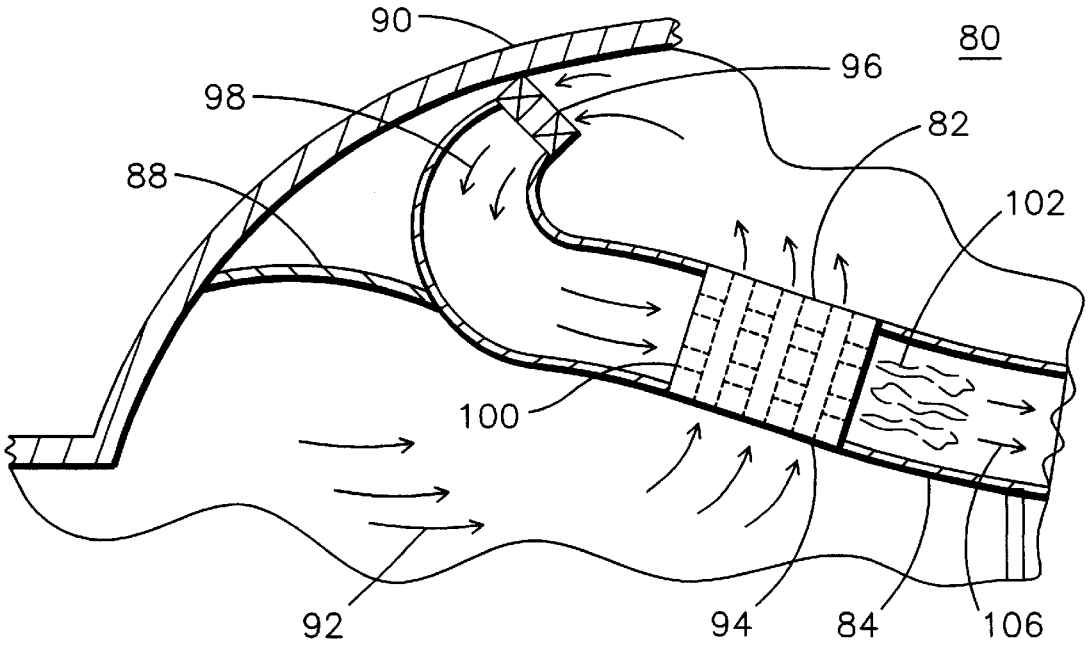
FIG. 5 is a partial side sectional view of the combustion system of FIG. 4.

A plurality of catalytic heat exchanger modules as described above may also be used in an annular-type combustion system such as the Siemens Model V84.3A gas turbine engine. FIG. 4 illustrates an end view of one such combustion system 80 where a plurality of catalytic heat exchanger modules 82 are spaced around an inlet to an annular combustion chamber 84. Pluralities of pilot burners 86 are placed among the catalytic modules 82, for example, with a pilot burner 86 between each two adjacent catalytic modules 82. A seal 88 is made from the engine casing 90 to the catalyst modules 82 as may best be seen in FIG. 5, which is a partial side sectional view of the combustion system 80. The seal 88 directs the flow of combustion air 92 into contact with non-catalytic surfaces 94 of the catalyst module 82 for removing heat there from. The pre-heated air is then directed by the engine casing 90 to the fuel injectors 96 for the injection of a combustible fuel downstream of the non-catalytic surfaces 94 to form a fuel-air mixture 98. The inlet of the annular combustor structure 84 then directs the fuel-air mixture 98 over the catalytic surfaces 100 of catalyst member 82 where the combustion process is initiated to create heat energy. Combustion is completed downstream of the catalytic heat exchanger 82 in the burnout zone 102 and the hot combustion gasses 106 are directed out of the combustor to a turbine. The pilot burners 86 each have an outlet to the combustion chamber burnout zone 102 for stabilizing the combustion therein.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A combustor comprising:

a heat exchanger module having a first passage defined by a non-catalytic material and a second passage defined by a catalytic material in a heat exchange relationship with the non-catalytic material; and a fuel injection apparatus disposed in a flow of combustion air downstream of the first passage and upstream of the second passage.

2. The combustor of claim 1, further comprising a means for directing the combustion air in sequence through the non-catalytic passage, the fuel injection apparatus and the catalytic passage.

3. The combustor of claim 1, wherein the non-catalytic passage and the catalytic passage are oriented in a cross-flow configuration through the heat exchanger module.

4. A gas turbine comprising:

a compressor for providing a flow of air;

a combustor for combusting a flow of fuel in the flow of air to produce a flow of combustion gas; and a turbine for extracting energy from the flow of combustion gas;

wherein the combustor further comprises:

a catalyst module having a catalytic surface and a non-catalytic surface in heat exchange relationship there between;

a fuel delivery apparatus; and a flow directing arrangement for directing the flow of air in sequence from the non-catalytic surface to the fuel delivery apparatus to the catalytic surface.

5. The gas turbine of claim 4, wherein the combustor further comprises a plurality of said catalyst modules arranged in an annular pattern around an inlet to an annular combustion chamber, and a plurality of pilot burners disposed in an annular pattern alternately spaced between respective ones of the plurality of catalyst modules.

6. A method of combusting a fuel comprising:

providing a catalyst device having a catalytic surface in heat exchange relationship with a non-catalytic surface;

directing fuel-free air over the non-catalytic surface to remove heat energy from the catalyst device and to pre-heat the fuel-free air;

adding a combustible fuel to the pre-heated fuel-free air to form a pre-heated fuel-air mixture; and directing the pre-heated fuel-air mixture over the catalytic surface to initiate combustion at least a first portion of the fuel.

7. The method of claim 6, wherein at least a second portion of the fuel is combusted in a combustion chamber downstream of the catalyst device, and further comprising:

providing a pilot burner having an outlet to the combustion chamber; and directing a second fuel-air mixture through the pilot burner to produce a pilot flame in the combustion chamber for stabilizing the combustion of the at least a second portion of the fuel in the combustion chamber.

8. The method of claim 6, wherein the combustible fuel is a first type of fuel, and further comprising:

supplying a second type of combustible fuel to the pre-heated fuel-free air until a predetermined temperature is achieved in the pre-heated fuel-free air; and terminating the supply of the second type of fuel after the predetermined temperature is achieved.

9. The method of claim 8, wherein the second type of combustible fuel comprises one of the group of hydrogen and propane.

* * * * *